US007070666B2

(12) United States Patent
Druschitz et al.

(10) Patent No.: US 7,070,666 B2
(45) Date of Patent: Jul. 4, 2006

(54) MACHINABLE AUSTEMPERED CAST IRON ARTICLE HAVING IMPROVED MACHINABILITY, FATIGUE PERFORMANCE, AND RESISTANCE TO ENVIRONMENTAL CRACKING AND A METHOD OF MAKING THE SAME

(75) Inventors: Alan Peter Druschitz, Forest, VA (US); David Carroll Fitzgerald, Concord, VA (US)

(73) Assignee: INTERMET Corporation, Troy, MI (US)

( * ) Notice: Subject to any disclaimer, the term of this patent is extended or adjusted under 35 U.S.C. 154(b) by 143 days.

(21) Appl. No.: 10/655,237

(22) Filed: Sep. 4, 2003

(65) Prior Publication Data

US 2004/0112479 A1 Jun. 17, 2004

Related U.S. Application Data

(60) Provisional application No. 60/408,174, filed on Sep. 4, 2002.

(51) Int. Cl.
*C21D 5/00* (2006.01)
*C21D 9/30* (2006.01)
*C22C 33/08* (2006.01)

(52) U.S. Cl. ..... 148/663; 148/612; 148/543

(58) Field of Classification Search ..... 148/321, 148/579, 663, 543, 612, 324; 420/13, 15
See application file for complete search history.

(56) References Cited

U.S. PATENT DOCUMENTS

| | | | | |
|---|---|---|---|---|
| 3,920,490 | A | 11/1975 | Koppenaal et al. | 148/12.4 |
| 4,032,368 | A | 6/1977 | Grange | 148/134 |
| 4,222,793 | A | 9/1980 | Grindahl | |
| 4,432,812 | A | 2/1984 | Rice | 148/36 |
| 4,484,953 | A | 11/1984 | Kovacs et al. | 148/3 |
| 4,541,878 | A | 9/1985 | Muhlberger et al. | 148/614 |
| 4,596,606 | A | 6/1986 | Kovacs et al. | |
| 4,838,956 | A | 6/1989 | Satou et al. | 148/3 |
| 4,880,477 | A | 11/1989 | Hayes et al. | |
| 5,028,281 | A | 7/1991 | Hayes et al. | 148/321 |
| 5,139,579 | A | 8/1992 | Kovacs | 148/545 |
| 5,180,450 | A | 1/1993 | Rao | 148/579 |

(Continued)

FOREIGN PATENT DOCUMENTS

| | | |
|---|---|---|
| EP | 0018445 | 11/1980 |

(Continued)

OTHER PUBLICATIONS

English abstract of Japanese patent 36117433 dated Aug. 6, 1986.*

(Continued)

*Primary Examiner*—Deborah Yee
(74) *Attorney, Agent, or Firm*—Howard & Howard

(57) ABSTRACT

A machinable austempered cast iron article has improved strength, machinability, fatigue performance, and resistance to environmental cracking. A method of making the machinable austempered cast iron article includes austenitizing an iron composition having a substantially pearlitic microstructure in an intercritical temperature range of between 1380° F. and 1500° F. This produces a ferritic plus austenitic microstructure. The ferritic plus austenitic microstructure is quenched into an austempering temperature range of between 575° F. and 750° F. within 3 minutes to prevent formation of pearlite. The ferritic plus austenitic microstructure is then austempered in the austempering temperature range of between 575° F. and 750° F. to produce a microstructure of a continuous matrix of equiaxed ferrite with islands of austenite. Finally, the microstructure of the continuous matrix of equiaxed ferrite with islands of austenite is cooled to ambient temperature to produce the machinable austempered cast iron article.

27 Claims, 3 Drawing Sheets

U.S. PATENT DOCUMENTS

| | | | | |
|---|---|---|---|---|
| 5,268,044 | A | 12/1993 | Hemphill et al. | 148/328 |
| 5,352,304 | A | 10/1994 | DeArdo et al. | 148/336 |
| 5,837,069 | A | 11/1998 | Deards et al. | |
| 5,849,114 | A | 12/1998 | Keough et al. | |
| 5,853,504 | A | 12/1998 | Nishimura | 148/324 |
| 6,258,180 | B1 * | 7/2001 | Wilde et al. | 148/321 |
| 6,277,216 | B1 | 8/2001 | Leap et al. | 148/335 |
| 6,406,565 | B1 | 6/2002 | Hashimura et al. | 148/333 |
| 2001/0024621 | A1 | 9/2001 | Leppanen | 420/8 |

FOREIGN PATENT DOCUMENTS

| | | |
|---|---|---|
| ES | 8104423 | 1/1981 |

OTHER PUBLICATIONS

Keyser,Carl, Materials Science in Engineering, second edition, 1974, p. 164.*

International Search Report of PCT International Application No. PCT/US03/27198; Feb. 23, 2004.

"Development of Austempered Ductile Cast Iron with Simultaneous High Yield Strength and Fracture Toughness by a Novel Two-Step Austempering Process"; vol. A315; Susil Putatunda; Sep. 30, 2001; Wayne State Univ., Detroit, MI 48202; XP-002269143; Material Science & Engineering A315 (2001) 70-80.

Warrick et al, "Austempered Ductile Iron Castings for Chassis Applications", SAE Technical Paper Series, 2000-01-1290, Mar. 6, 2000.

Gundlach, "Improving the Properties of Austempered Ductile Iron, research project No. 32", Ductile Iron Society, Apr. 2001.

Zanardi, "The Development of Machinable ADI in Italy", 2002 World Conference on ADI, 2002.

Zauscher, "Nomenclature for Steels and Alloys", Notes for ME 083, Duke University, 2002.

Key to Steel Article, "Relation between CE structure and mechanical properties", 2002.

Brandenburg, "Machining Austempered Ductile Iron", Manufacturing Engineering, May 2002, vol. 128 No. 5, 2002.

Fargues, "Intercritical Treatments of Cast Irons: The Search for High Characteristics", 60th World Foundry Congress, 1993.

Fargues, "Intercritical Treatments of Cast Irons: The Search for High Characteristics", Fonderie Fondeur d'aujord'hui, 1993.

H. Mayer and B. Barbezat, "Sulzer GGG-100, Austempered Ductile Iron (ADI) Also for Heavy Sections", in the Proceeding of the 2nd International Conference on Austempered Ductile Iron: Your Means to Improved Performance, Productivity and Cost, University of Michigan, Ann Arbor (1986) pp. 99-115.

H. Muhlberger, "Progress in the Production, Understanding and Applications of Germanite—Austempered Ductile Iron", in the Proceedings of the 2nd International Conference on Austempered Ductile Iron: Your Means to Improved Performance, Productivity and Cost, University of Michigan, Ann Arbor (1986) pp. 55-93.

J.R Davis, "ASM Specialty Handbook: Cast Irons", ASM International, The Materials Information Society, Materials Park, OH (1996) pp. 33, 56-63.

Cees van de Velde, "Nodular Cast iron before it was even invented", Last revision: Dec. 12, 1999, 3 pages.

Cast Iron Grades "Ductile Iron" (to BS2789 : 1985) Including Austempered Ductile Iron (ADI), Compcacted Graphite Iron; The Castings Development Centre Member; extracted from database www.thdick.co.uk/grades.htm on Aug. 21, 2002 and Sep. 25, 2005, 5 pages.

Ductile Iron Society, "Ductile Iron Data for Design Engineers", Published by: Rio Tinto Iron & Titanium, Inc.,; Montreal, Quebec, Canada, Copyright 1990, Revised and Reprinted 1998 by: QIT-Fer et Titane Inc., extracted from database www.ductile.org/didata/default.htm on Aug. 22, 2002 and Sep. 25, 2005, 10 pages.

* cited by examiner

MACHINABLE AUSTEMPERED CAST IRON ARTICLE HAVING IMPROVED MACHINABILITY, FATIGUE PERFORMANCE, AND RESISTANCE TO ENVIRONMENTAL CRACKING AND A METHOD OF MAKING THE SAME

RELATED APPLICATIONS

This patent application claims priority to and all advantages of U.S. Provisional Patent Application No. 60/408,174, which was filed on Sep. 4, 2002.

BACKGROUND OF THE INVENTION

1) Field of the Invention

The subject invention generally relates to a machinable austempered cast iron article having improved machinability, fatigue performance, and resistance to environmental cracking, a method of making the machinable austempered cast iron article, and a machinable austempered cast iron composition. More specifically, the subject invention relates to a machinable austempered cast iron article having a microstructure of a continuous matrix of equiaxed ferrite with islands of austenite that exhibits improved strength, ductility, machinability, fatigue performance, and resistance to environmental cracking.

2) Description of the Related Art

Regular ductile iron (RDI) articles and regular austempered ductile iron (ADI) articles are well known in the art, as are methods for making these articles. RDI articles are used extensively in automotive applications and ADI articles are used in limited vehicular applications, including crankshaft and chassis components. RDI articles are generally made by casting a ductile iron composition without subjecting the ductile iron composition to a post-casting heat treatment process. The ductile iron composition can vary in percentage of components, but must include carbon and sufficient alloying elements to form a microstructure of well-formed graphite nodules in a matrix of ferrite and pearlite in the regular ductile iron articles.

Typical RDI articles that require a good combination of strength and toughness have the ferritic and pearlitic microstructure, not a substantially pearlitic microstructure. The ferritic and pearlitic microstructure has superior physical properties to the substantially pearlitic microstructure when the ductile iron composition is cast without subjecting the ductile iron composition to post-casting heat treatment. Alternatively, RDI articles can be heat treated by normalizing or quenching and tempering. However, the typical ductile iron compositions do not respond to a heat treatment process of the present invention, forming unwanted pearlite during rapid cooling. Thus, typical ductile iron compositions are not suitable for use with the heat treatment process of the subject invention.

ADI articles are made by subjecting the ductile iron composition to a post-casting heat treatment process. A microstructure of the ductile iron composition prior to the heat treatment process is not a factor and is overlooked, with emphasis on the heat treatment process itself for producing the ADI article. ADI articles are generally produced by austenitizing followed by austempering.

Another method for producing ADI articles is step austenitizing, which is disclosed in "Improving The Properties of Austempered Ductile Iron" to Gundlach (the DIS publication), but remains an experimental method that has not been applied to and optimized for production. Step austenitizing is a process by which the ductile iron composition is heated to and held at an initial austenitizing temperature. The step austenitizing proceeds by quenching the ductile iron composition to sequentially lower temperatures and holding the ductile iron composition at each temperature for a short amount of time. The process ends by quenching the ductile iron composition to produce the ADI article. The ADI article produced through step austenitizing typically has an ausferritic microstructure. The ausferritic microstructure generally provides higher strength than the regular ductile iron articles, but is also less ductile and less machinable than the regular ductile iron articles.

Austenitizing followed by austempering is performed by first austenitizing a ferritic and pearlitic microstructure at an austenitizing temperature, typically in a range of from 1550° F. to 1650° F., although austenitizing temperatures as low as 1450° F., which may be in an intercritical temperature range, have been documented. The ductile iron composition is then austempered at a significantly lower temperature, typically between 350° F. and 725° F., to produce the regular austempered ductile iron article. Austenitizing and austempering temperatures are varied to achieve desired physical properties in the regular austempered ductile iron articles. The resulting regular austempered ductile iron articles have an ausferrite microstructure, i.e., acicular ferrite plus austenite. Time at temperature for the austenitizing and austempering process is also crucial. For articles with the ferritic and pearlitic starting microstructure, the carbon must diffuse into the austenitic matrix from graphite nodules interdispersed throughout the ductile iron composition to form a high carbon austenite before quenching to the austempering temperature. As a result, an austenitizing time of 90 minutes is typical to achieve production of the high carbon austenite.

ADI articles that are austenitized at lower temperatures exhibit better machinability than ADI articles austenitized at higher temperatures. However, the acicular ferritic plus austenitic microstructure (ausferrite) that is produced through austenitizing at the lower temperatures does not have sufficient strength for many applications in which ADI articles are used.

Spanish Patent No. ES 8104423 to Muhlberger discloses a method for producing another austempered ductile iron article having a microstructure of austenite mixed with bainite and spherical graphite. The Muhlberger austempered ductile iron (ADI) article is produced by heat treating a ductile iron composition as shown in Table 1.

TABLE 1

| Element | Wt. % |
|---|---|
| Carbon | 2.5–3.7 |
| Silicon | 2.0–3.0 |
| Manganese | >0–<0.3 |
| Copper | 0.1–1.5 |
| Molybdenum | 0.2–0.8 |
| Nickel | 0–3.0 |
| Iron | Remainder |

The heat treating is performed by austenitizing the ductile iron composition in a temperature range of from 1472° F. to 1580° F. for between 10 and 60 minutes. The ductile iron composition is then quenched over a period of less than 2 minutes to a temperature range of between 662° F. and 752° F. The ductile iron composition is maintained within the temperature range of between 662° F. and 752° F. for a period of between 5 and 60 minutes to produce the Muhlberger ADI article having a microstructure of austenite mixed with bainite and spherical graphite, which is a regular austempered ductile iron structure. The Muhlberger ADI article is insufficient for applications of the subject invention. The molybdenum composition is too high, resulting in the iron article having a Brinell Hardness that is too high, and the composition requires manganese. Furthermore, the resulting microstructure of the austempered ductile iron composition is austenite mixed with bainite and spherical graphite, and does not contain equiaxed ferrite with islands of austenite because the method does not begin with a substantially pearlitic microstructure prior to austenitizing. In addition, the combination of chemistry and austenitizing temperature are not suitable for the subject invention. Referring to FIG. 5, Muhlberger ADI exhibits a different relationship between yield strength and hardness. Thus, the Muhlberger ADI has physical properties that are insufficient for applications of the subject invention.

RDI articles and ADI articles have physical properties that are suitable for many applications, however, RDI articles and ADI articles are often not suitable for the same applications. Referring to FIG. 1, RDI articles can have higher ductility, measured by elongation, than ADI articles. However, for the same strength level, ADI articles have higher ductility than RDI articles. Properties of normalized ductile iron (normalized DI) articles and quenched and tempered ductile iron (quenched and tempered DI) articles are also shown. RDI articles, normalized DI articles, and quenched and tempered DI articles are most commonly used in applications that require extensive machining. Even though physical properties of the articles can be manipulated by adjusting production processes and chemistries of the ductile iron composition, RDI articles, normalized DI articles, and quenched and tempered DI articles do not have sufficient ultimate tensile or yield strength to satisfy strength requirements of many applications.

On the other hand, ADI articles, as shown in FIG. 5, have sufficient strength for many applications that cannot use RDI articles because of lack of sufficient strength. However, ADI articles are significantly less machinable than RDI articles. ADI articles also exhibit insufficient flaw tolerance and insufficient resistance to environmental cracking, i.e., resistance to cracking while being subjected to a combination of strain and various types of fluid such as water, oil, and fuel. As a result, ADI articles show insufficient performance in fatigue life tests, making the ADI articles unsuitable for applications that will subject the articles to cyclical loading and unloading. Furthermore, prior art ADI articles achieve a lowest Brinell hardness (BHN) of 268 BHN. Therefore, the prior art ADI articles are also unsuitable for applications that require extensive machining.

Thus, there remains an opportunity for a machinable austempered cast iron (MADI) article and a method of producing the MADI article having a unique combination of improved strength, ductility, machinability, fatigue performance, and resistance to environmental cracking that has not been achieved by the prior art.

SUMMARY OF THE INVENTION AND ADVANTAGES

The subject invention provides a machinable austempered cast iron article, a machinable austempered cast iron composition, and a method of making the machinable austempered cast iron article. The machinable austempered cast iron article is made from an iron composition that has a substantially pearlitic microstructure. The substantially pearlitic microstructure includes carbon, silicon, nickel, copper, and molybdenum.

The method of making the machinable austempered cast iron article includes austenitizing the substantially pearlitic microstructure in an intercritical temperature range of from 1380° F. to 1500° F. for a period of at least 10 minutes. This produces a ferritic plus austenitic microstructure. Having a substantially pearlitic microstructure prior to austenitizing allows for improved time to complete austenitizing that is not possible with other microstructures. The method proceeds by quenching the ferritic plus austenitic microstructure at a rate sufficient to prevent formation of pearlite. Next is austempering the ferritic plus austenitic microstructure in an austempering temperature range of from 575° F. to 750° F. for a period of at least 8 minutes to produce a microstructure of a continuous matrix of equiaxed ferrite with islands of austenite. The microstructure of the continuous matrix of equiaxed ferrite with islands of austenite is then cooled to ambient temperature to produce the machinable austempered cast iron article.

The machinable austempered cast iron article of the subject invention has improved strength, ductility, machinability, fatigue performance, and resistance to environmental cracking. The improved strength and machinability makes the machinable austempered cast iron article ideal for crankshaft and chassis components that currently sacrifice strength for machinability, or machinability for strength. The improved strength also provides for an improvement in weight for the machinable austempered cast iron article, and thus a decrease in cost. Furthermore, the method of the subject invention is capable of reducing the time required to make the iron article, which can also result in lower costs.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION OF THE PREFERRED EMBODIMENT

Figure 1:
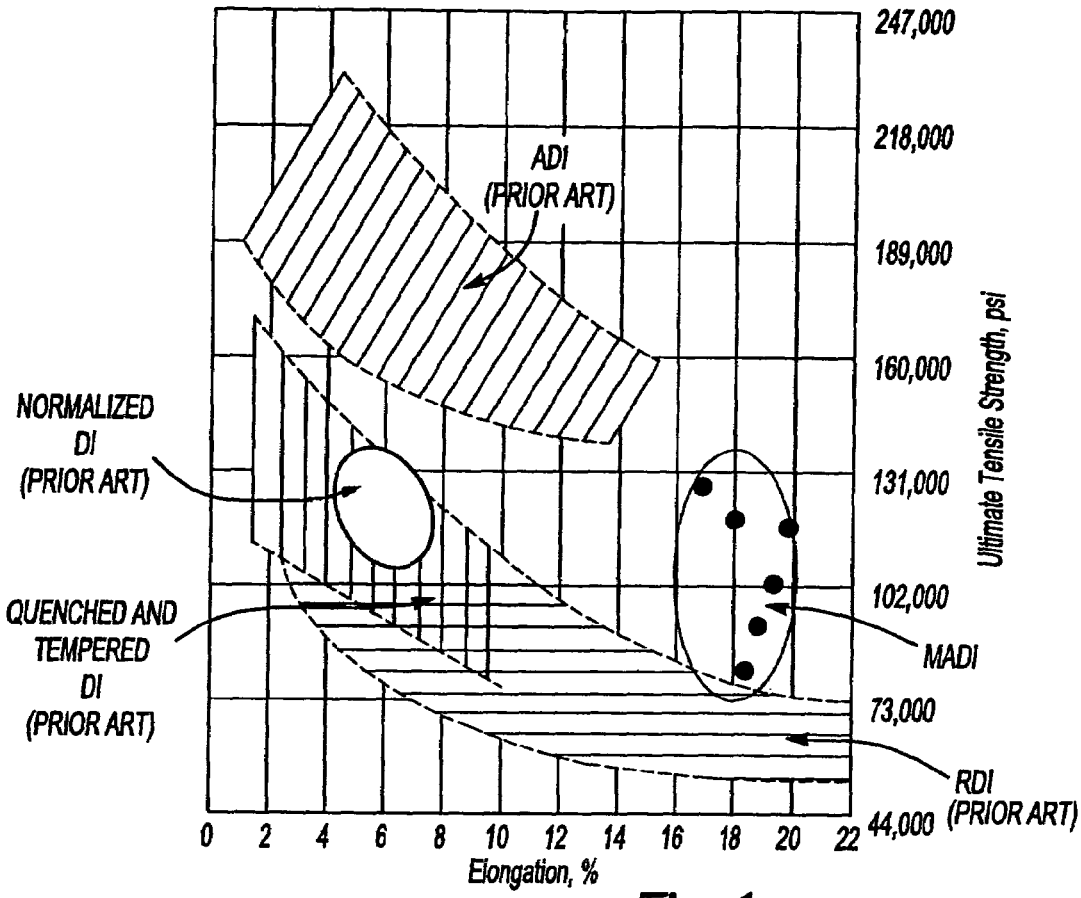
FIG. 1 is a graph illustrating a relationship between Ultimate Tensile Strength, in psi, and Elongation, in %, with respect to prior art ductile iron articles (Normalized DI, Quenched and Tempered DI, and RDI), regular austempered ductile iron (ADI) articles, and machinable austempered cast iron (MADI) articles made according to a method of the subject invention.

The subject invention provides a machinable austempered cast iron article and a method of making the machinable austempered cast iron article from an iron composition. The machinable austempered cast iron article has improved strength, ductility, machinability, fatigue performance, and resistance to environmental cracking. Improved machinability makes the machinable austempered cast iron article ideal for many applications in the automotive industry. Furthermore, improved strength provides for an improvement in weight and cost of the machinable austempered cast iron article.

The iron composition includes carbon, silicon, nickel, copper, molybdenum, and iron. Optimum ranges for the iron composition of the present invention are disclosed in Table 2.

TABLE 2

| Element | Wt. % |
|---|---|
| Carbon | 3.30–3.90 |
| Silicon | 1.90–2.70 |
| Nickel | 0.45–2.05 |
| Copper | 0.55–1.05 |
| Molybdenum | 0–0.20 |
| Iron | Remainder |

An amount of each element is varied within the ranges to ensure sufficient formation of a desired microstructure within the iron composition during production of the machinable austempered cast iron article. For example, formation of the desired microstructure is determined primarily by two factors: cooling rate and chemistry of the iron composition. Cooling rate is controlled by a number of factors that vary according to aspects of each particular production line, such as geometry of a particular article, composition of material used in making a mold for producing the article, i.e. sand or metal, and cooling time for the article in the mold before being removed. The cooling time can be slightly adjusted by controlling a speed of the production line, but only to a limited extent. Thus, microstructure is, in large part, controlled through variation in the amount of each element in the iron composition.

The carbon included in the iron composition is a necessary component of various microstructures formed at different stages in the production of the machinable austempered cast iron article. Silicon, nickel, copper, and molybdenum in the iron composition are alloying agents. The alloying agents are necessary to promote a substantially pearlitic microstructure and to suppress the formation of pearlite during the production of the machinable austempered cast iron article. It is to be understood that the microstructure is substantially pearlitic in the "as cast" condition. By substantially pearlitic microstructure it is meant that the microstructure includes greater than 50% pearlite. Preferably, the substantially pearlitic microstructure includes at least 80% pearlite. Additional alloying agents can also be used, such as manganese, chromium, tin, arsenic, and antimony, but are not specifically required for the subject invention. The remainder of the iron composition is iron. The most preferred iron composition includes:

TABLE 3

| Element | Wt. % |
|---|---|
| Carbon | 3.70 |
| Silicon | 2.50 |
| Nickel | 1.85 |
| Copper | 0.85 |
| Molybdenum | 0.05 |
| Iron | Remainder |

The iron composition is a ductile iron composition and has improved castability and production economies over other types of iron compositions. In other embodiments, the iron composition is a gray iron composition, a compacted graphite iron composition, or a carbidic ductile iron composition, depending on physical property and production requirements for a particular application.

The method includes austenitizing the substantially pearlitic microstructure in an intercritical temperature range of from 1380° F. to 1500° F. Preferably the substantially pearlitic microstructure is austenitized in the intercritical temperature range of from 1380° F. to 1472° F., more preferably in the intercritical temperature range of from 1380° F. to 1449° F. The substantially pearlitic microstructure is maintained in the intercritical temperature range for a period of at least 10 minutes, preferably for a period of from 10 to 360 minutes. The austenitizing step produces a ferritic plus austenitic microstructure. The substantially pearlitic microstructure is an essential element to the austenitizing step of the subject invention. Carbon necessary for the formation of an austenitic portion of the ferritic plus austenitic microstructure is derived from the substantially pearlitic microstructure. The substantially pearlitic microstructure allows the austenitic portion of the ferritic plus austenitic microstructure to form in as little as 10 minutes. This allows for improved production speed for the overall process.

In a quenching step, the ferritic plus austenitic microstructure is quenched from the austenitizing temperature into an austempering temperature range of from 575° F. to 750° F. Preferably, the quenching step occurs in a salt bath with water injection.

In an austempering step, the ferritic plus austenitic microstructure is held in the austempering temperature range for at least 8 minutes. The austempering step prevents formation of a martensitic or pearlitic microstructure, which have undesirable physical properties for intended applications of the subject invention. The austempering step produces a microstructure of a continuous matrix of equiaxed ferrite with islands of austenite. The microstructure of the continuous matrix of equiaxed ferrite with islands of austenite is produced because only a portion of the substantially pearlitic microstructure is transformed into the austenitic portion of the ferritic plus austenitic microstructure during the austenitizing step. During austempering, the ferritic portion of the ferritic plus austenitic microstructure remains as ferritic microstructure, as opposed to acicular or bainitic ferrite. The austenitic portion of the ferritic plus austenitic microstructure is stabilized.

An amount of ferrite in the microstructure of the continuous matrix of equiaxed ferrite with islands of austenite depends on the intercritical temperature at which the substantially pearlitic microstructure is austenitized. At higher temperatures within the intercritical temperature range, more austenite forms, with a remainder of the pearlitic microstructure forming ferrite. The austenite is maintained and stabilized in the austempering step. Therefore, the amount of austenite in the microstructure of the continuous matrix of equiaxed ferrite with islands of austenite is limited by the amount of the austenite formed prior to the austempering step.

In a cooling step, the microstructure of the continuous matrix of equiaxed ferrite with islands of austenite is cooled to ambient temperature to retain the microstructure of the continuous matrix of equiaxed ferrite with islands of austenite produced in the austempering step. The microstructure of the continuous matrix of equiaxed ferrite with islands of austenite is cooled to ambient temperature by air cooling or water quenching.

More specifically, the method includes casting the iron composition at a temperature of greater than 2200° F., at which temperature the iron composition is molten. Next is a cooling step, in which the iron composition is cooled to a temperature of from 1000° F. to 1340° F. The iron composition is held at the temperature of from 1000° F. to 1340° F. for at least 8 seconds to form the substantially pearlitic microstructure.

In the austenitizing step, the substantially pearlitic microstructure is heated in the intercritical temperature range of from 1380° F. to 1500° F. Preferably the substantially pearlitic microstructure is austenitized in a temperature range of from 1380° F. to 1472° F., more preferably in a temperature range of from 1380° F. to 1449° F. The substantially pearlitic microstructure is maintained in the intercritical temperature range for the period of at least 10 minutes, preferably for the period of from 10 to 360 minutes. The austenitizing step produces the ferritic plus austenitic microstructure.

In a quenching step, the ferritic plus austenitic microstructure is quenched into the austempering temperature range of from 575° F. to 750° F. to stabilize the ferritic plus austenitic microstructure produced in the austenitizing step. Preferably, the ferritic plus austenitic microstructure is quenched into the austempering temperature range within a period of from 5 to 180 seconds. Preferably, the quenching step is performed in the salt bath with water injection. The salt bath contains liquid including at least one of nitrate salts, nitrite salts, and combinations of nitrate salts and nitrite salts for rapidly cooling the ferritic plus austenitic microstructure. More specifically, the salt bath contains liquid including Park Metallurgical low temperature draw salt manufactured by Heatbath Corporation. Alternatively, the second quenching step may be performed in a fluidized bed. The machinable austempered cast iron article is preferably a crankshaft or a chassis component, but the method is not limited to production of such components.

In the austempering step, the ferritic plus austenitic microstructure is held in the austempering temperature range of from 575° F. to 750° F. to stabilize the austenite and prevent the formation of a martensitic or pearlitic microstructure. The ferritic plus austenitic microstructure is maintained in the austempering temperature range for the period of at least 8 minutes, preferably for a period of from 8 to 1440 minutes, and more preferably for a period of from 60 to 180 minutes. The austempering step produces the microstructure of the continuous matrix of equiaxed ferrite with islands of austenite. Finally, the machinable austempered cast iron is cooled to ambient temperature.

As shown in Table 4, a range in average ultimate tensile strength (UTS), yield strength (YS), elongation (% El.), and Brinell hardness (BHN) of machinable austempered cast iron articles having the iron composition as set forth in Table 3, austenitized at different intercritical temperatures within the intercritical temperature range, correlates to the intercritical temperature at which the machinable austempered cast iron articles are austenitized, and thus to a ratio of ferrite to austenite in the machinable austempered cast iron articles.

TABLE 4

| Intercritical Temperature, ° F. | 1380 | 1420 | 1440 | 1460 | 1480 | 1500 |
|---|---|---|---|---|---|---|
| UTS, psi | 77,304 | 90,891 | 101,701 | 114,501 | 119,031 | 129,702 |
| YS, psi | 57,301 | 60,999 | 65,969 | 72,025 | 76,054 | 84,024 |
| % El. | 17.9 | 19.5 | 19.6 | 20.3 | 17.9 | 16.8 |
| BHN | 185 | 204 | 227 | 241 | 255 | 272 |

Therefore, the intercritical temperature at which the machinable austempered cast iron articles are austenitized is adjusted to achieve desired properties of the machinable austempered cast iron article for particular applications.

Figure 2:
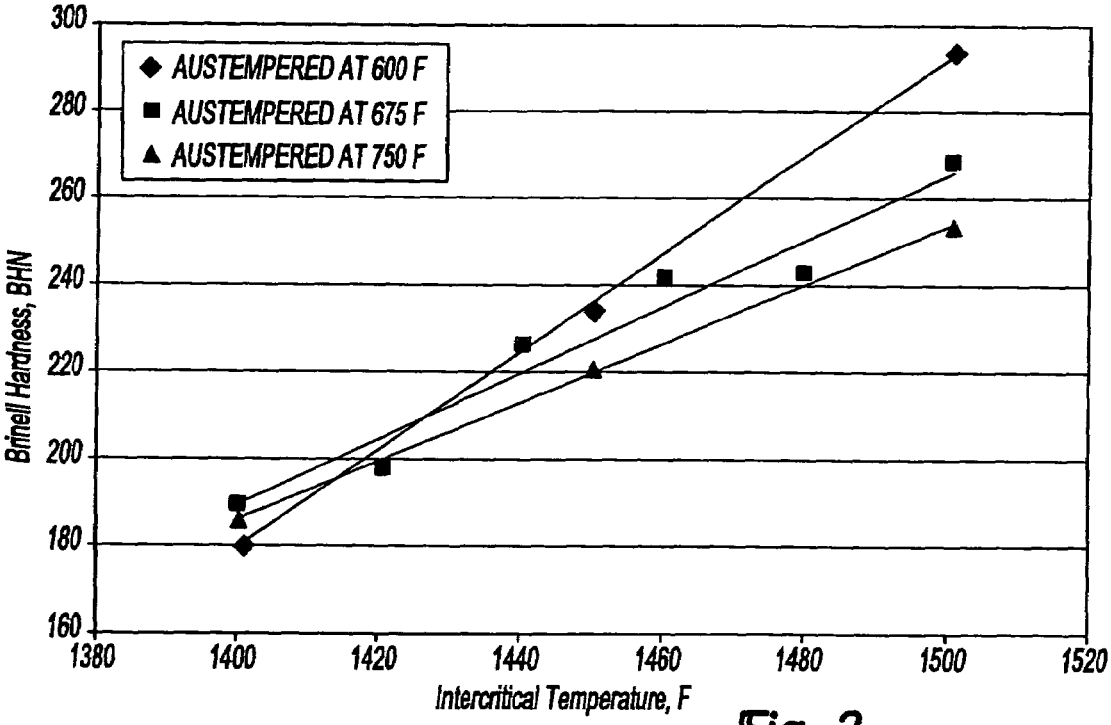
FIG. 2 is a graph illustrating a relationship between Brinell Hardness, in BHN, and intercritical temperature, in degrees Fahrenheit, for machinable austempered cast iron articles that were austempered at different temperatures.

Likewise, austempering temperature has an effect on the BHN of the machinable austempered cast iron article. Referring to FIG. 2, machinable austempered cast iron articles that are austempered at 600° F. exhibit a greater range of BHNs across the intercritical temperature range than machinable austempered cast iron articles that are austempered at 675° F. Likewise, the machinable austempered cast iron articles that are austempered at 675° F. exhibit a greater range of BHNs across the intercritical temperature range than machinable austempered cast iron articles that are austempered at 750° F. Thus, the austempering temperature is adjusted, in concert with the intercritical temperature, to achieve desired properties of the machinable austempered cast iron article for particular applications.

Time at intercritical temperature also has an effect on the BHN of the machinable austempered cast iron article, albeit not as significant as intercritical or austempering temperature. As a result of only minor differences in BHN, production line and cost strategies generally dictate the time at temperature for the machinable austempered cast iron article during the austenitizing and austempering steps, as long as the time at temperature is at least 10 minutes for the austenitizing step and at least 8 minutes for the austempering step.

The machinable austempered cast iron article has improved strength and ductility, as measured through a number of standard testing procedures to be set forth below. Generally, strength refers to UTS and YS, and ductility refers to the % El. The improved strength and ductility is attributable to the microstructure of the continuous matrix of equiaxed ferrite with islands of austenite of the machinable austempered cast iron article.

Preferably, the machinable austempered cast iron article has a BHN of between 180 and 340 BHN, as measured through standard procedures known to those skilled in the art. As shown above in Table 4, the BHN of the machinable austempered cast iron article has a direct correlation to the intercritical temperature at which the iron composition is austenitized. Referring to FIG. 2, machinable austempered cast iron articles austenitized at lower temperatures in the intercritical temperature range of between 1380° F. and 1500° F. have lower BHNs than machinable austempered cast iron articles austenitized at higher temperatures in the intercritical temperature range. The machinable austempered cast iron article can be produced having BHNs of less than 269 BHN.

Figure 5:
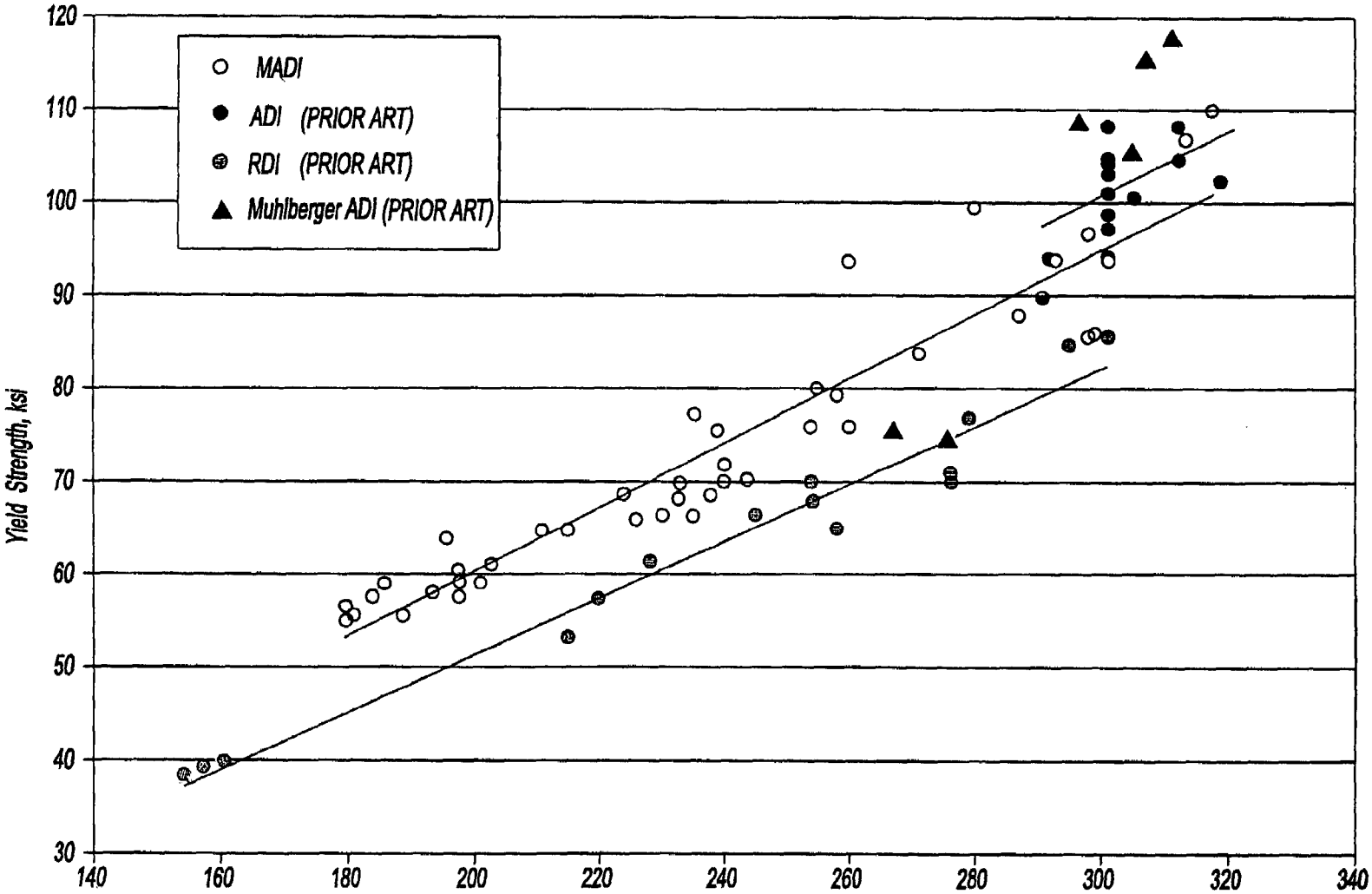
FIG. 5 is a graph illustrating a relationship between Brinell Hardness and Yield Strength for machinable austempered cast iron articles (MADI), regular ductile iron (RDI) articles of the prior art, and regular austempered ductile iron (ADI) articles of the prior art.

Preferably, as shown in FIG. 5, the machinable austempered cast iron article has a YS of between 50,000 and 125,000 psi, measured according to the protocol of ASTM E8. The ASTM E8 protocol for YS employs an offset method. A stress-strain plot is generated for a number the machinable austempered cast iron articles. A line is drawn parallel to a linear portion of the stress-strain plot starting at a predetermined offset, typically 0.2%. The intersection of the line with the stress-strain plot indicates the yield strength of the machinable austempered cast iron article. The YS of the machinable austempered cast iron article directly correlates to the BHN. This property of the machinable austempered cast iron article satisfies requirements of applications that require improved YS and machinability. The improved YS allows for efficient production of machinable austempered cast iron articles with less material while achieving sufficient performance, thus reducing the weight of the machinable austempered cast iron article.

Preferably, as generally shown in FIG. 1, the machinable austempered cast iron article has a range of UTS of between 70,000 and 170,000 psi and a range of % El. of between 14% and 22%, both as measured according to the protocol of ASTM E8. The ASTM E8 protocol for UTS includes dividing a maximum load carried by the machinable austempered cast iron article during a tension test by an original cross-sectional area of the machinable austempered cast iron article. The ASTM E8 protocol for % El. includes creating a pair of gage marks having an initial length between the gage marks on the machinable austempered cast iron article. Next is performing the tension test until the machinable austempered cast iron article breaks. The % El is determined by dividing a change in length between the gage marks by the initial length between the gage marks and multiplying this result by 100. Therefore, the machinable austempered cast iron article provides an improved combination of UTS and % El. The improved combination of UTS and % El. allows the machinable austempered cast iron article to be used in a variety of applications that require both improved strength and % El.

Figure 3:
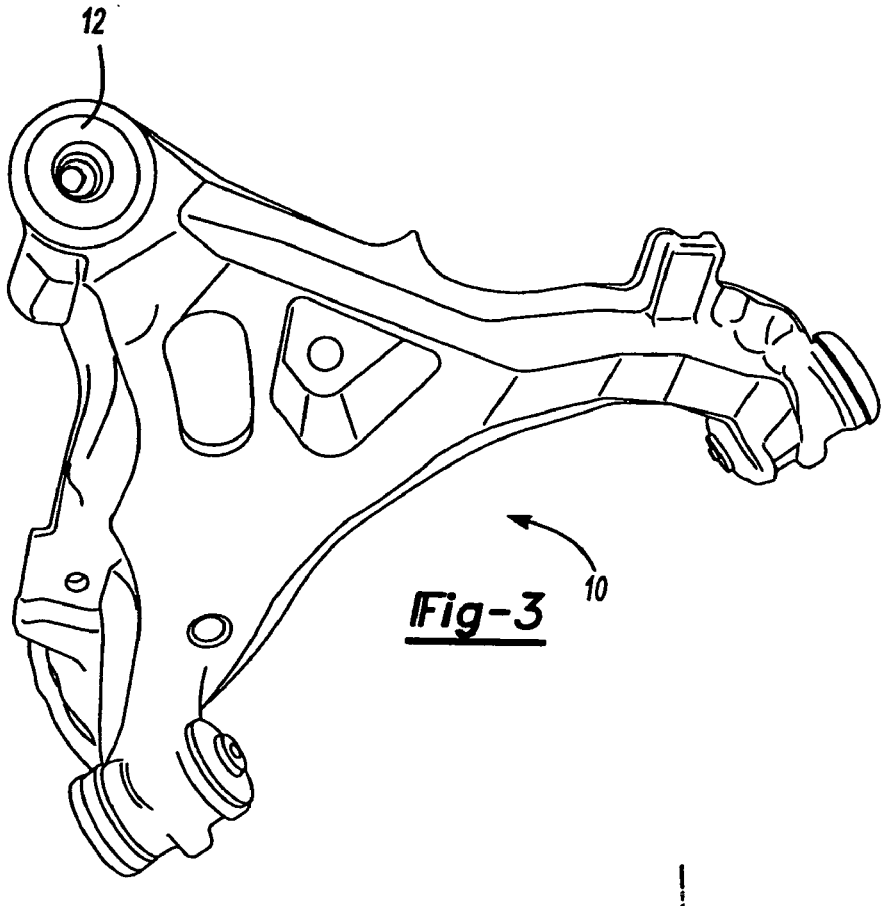
FIG. 3 is a front view of an embodiment of the machinable austempered cast iron article, wherein the machinable austempered cast iron article is a lower control arm.

In one embodiment, as shown at 10 in FIG. 3, the machinable austempered cast iron article is a lower control arm having a ball joint 12. For testing purposes, lower control arms 10 were used that were comprised of regular ductile iron (RDI) grade 65-45-12 of the prior art, regular austempered ductile iron (ADI) of the prior art having a BHN of 302 BHN, and the machinable austempered cast iron composition (MADI) of the subject invention, heat treated through the method of the subject invention, having a BHN of 243 BHN. A lower control arm testing apparatus was developed to simulate loading that the lower control arm 10 would experience in vehicular applications. A test was performed to measure fatigue life of the lower control arm 10. The lower control arm 10 was positioned in a mounting fixture with a solid steel block in place of a jounce stop. A 100 kN actuator of the servohydraulic variety was suspended from a vertical support frame. The actuator was attached to the ball joint 12 via an angled end-fixture. The actuator was positioned to apply a load through a centerline of the ball joint 12 at 18 degrees forward to aft and 18 degrees inboard to outboard relative to a vertical axis. The lower control arm testing apparatus was programmed to apply a sinusoidal load of from 17,793 N to 47,596 N at a rate of 1.5 Hz until loss of load or until a 6.4 mm crack was detected. The results of the lower control arm fatigue test are shown in Table 5.

TABLE 5

| | Lower Control Arm | | |
|---|---|---|---|
| | RDI (prior art) | ADI (prior art) | MADI |
| No. of Samples | 36 | 6 | 16 |
| $B_{10}$ Life | 75,296 | 45,582 | 239,923 |
| Median Life | 123,805 | 111,1194 | 645,213 |
| Low | 50,188 | 54,721 | 162,452 |
| High | 163,271 | 340,085 | 1,000,463 |

The $B_{10}$ life, median life, and the range of the results from the lowest to the highest fatigue life show that the lower control arm 10, and thus the MADI of the subject invention, heat treated through the method of the subject invention, has improved flaw tolerance over RDI and ADI of the prior art. Therefore, machinable austempered cast iron articles produced according to the method of the subject invention are ideal for lower control arm applications in which the lower control arm 10 is subjected to repeated loading cycles, i.e., fatigue loading.

UTS testing was also performed on the same lower control arm testing apparatus. A straight end fixture was substituted for the angled-end fixture used in the fatigue life test. The lower control arm testing apparatus was programmed to apply a ramped load at a rate of 0.01 Hz up to a maximum load of 94,000 N. The 94,000 N maximum load represents a threshold that the lower control arm 10 must exceed to be suitable for vehicular applications. The lower control arm 10 having a BHN of 243 BHN did not succumb to the maximum load of 94,000 N. Therefore, the lower control arm 10 has sufficient UTS for vehicular applications using the lower control arm 10.

Figure 4:
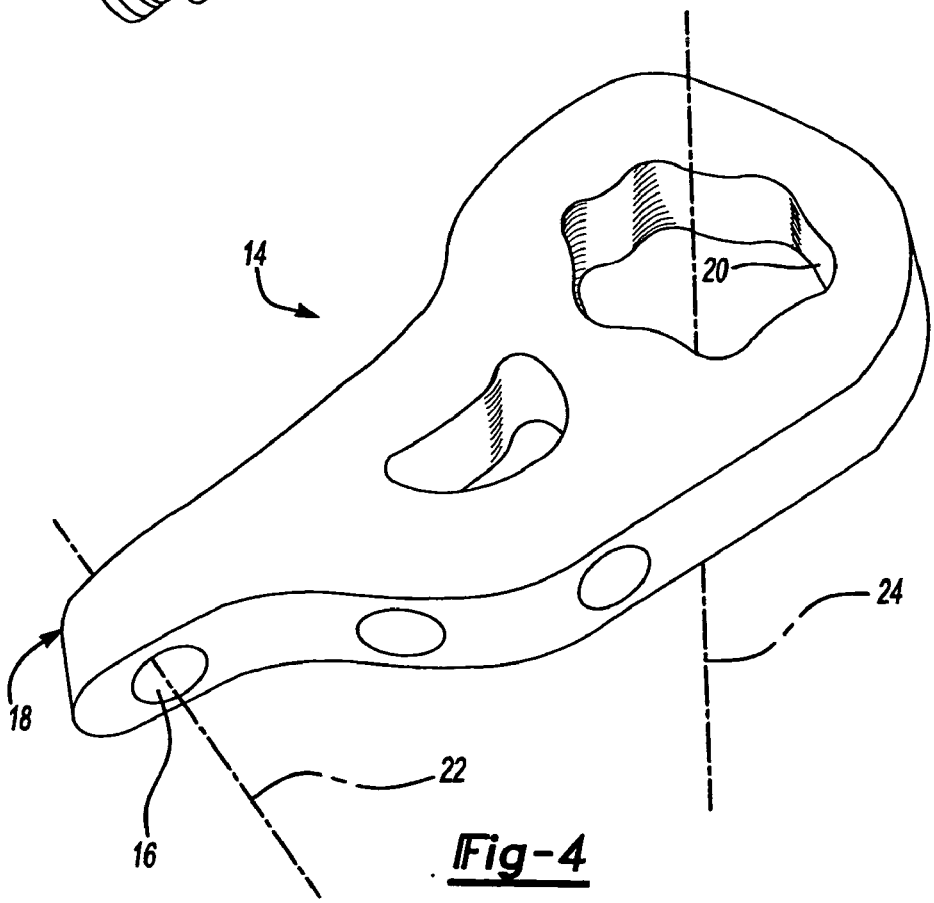
FIG. 4 is a front view of another embodiment of the machinable austempered cast iron article, wherein the machinable austempered cast iron article is a torsion bar adjuster.

In another embodiment, the machinable austempered cast iron article is a torsion bar adjuster, shown generally at 14 in FIG. 4, having a bolt indentation 16 at a first end 18. The torsion bar adjuster 14 defines a hex hole 20 perpendicular to the bolt indentation 16. An axis 22 passing though a center of the bolt indentation 16 is located 129.9 mm from an axis 24 passing through a center of the hex hole 20. For testing purposes, torsion bar adjusters 14 were used that were comprised of RDI of the prior art having a BHN of 246 BHN, ADI of the prior art having a BHN of 302 BHN, and the MADI of the subject invention, heat treated through the method of the subject invention, having BHNs of 200 BHN and 243 BHN. A torsion bar adjuster testing apparatus was designed to simulate loading that the torsion bar adjuster 14 would experience in vehicular applications. A test was performed to measure fatigue life of the torsion bar adjuster 14. The torsion bar adjuster 14 was vertically positioned in a base fixture with the bolt indentation 16 in an up position. A hex bar was placed through the hex hole 20 to secure the torsion bar adjuster 14 in place. A 100 kN actuator of the servohydraulic variety was positioned to apply a load through the bolt indentation 16. The torsion bar adjuster testing apparatus was programmed to apply a sinusoidal torque from 2,300 N-m to 7,500 N-m at a rate of 10 Hz until loss of load. The results of the torsion bar adjuster fatigue test are shown in Table 6.

TABLE 6

| | Torsion Bar Adjuster | | | |
|---|---|---|---|---|
| | RDI (prior art) | ADI (prior art) | MADI (BHN = 200) | MADI (BHN = 243) |
| No. of Samples | 17 | 38 | 20 | 23 |
| B10 Life | 371,306 | 111,250 | 452,702 | 781,519 |
| Median Life | 735,635 | 513,999 | 642,548 | 1,555,059 |
| Low | 287,024 | 193,980 | 496,001 | 449,952 |
| High | 1,436,067 | 7,344,713 | 1,074,230 | 2,524,054 |

The $B_{10}$ life, median life, and the range of the results from the lowest to the highest fatigue life show that the torsion bar adjuster 14 comprised of the MADI of the subject invention heat treated through the method of the subject invention has improved fatigue performance and flaw tolerance over torsion bar adjusters 14 comprised of RDI and ADI of the prior art. Therefore, the machinable austempered cast iron articles of the subject invention are ideal for torsion bar adjuster applications in which the torsion bar adjuster 14 is subjected to repeated loading cycles, i.e., fatigue loading.

Milling and drilling tests were performed to verify the machinability of the machinable austempered cast iron articles in light of the combination of BHN, UTS, YS and % El. measured in prior tests. Milling and drilling are two principal methods that will be employed in machining the machinable austempered cast iron articles. The machinable austempered cast iron articles will often be subjected to extensive milling and drilling. Thus, the machinable austempered cast iron articles must be conducive to milling and drilling to be economically and mechanically feasible for use in automotive applications, which generally require mass production of the machinable austempered cast iron articles. Machinability of machinable austempered cast iron articles, in general, is not accurately predictable based only upon % El. and BHN, although % El. and BHN of the machinable austempered cast iron article generally suggest a relative machinability for the machinable austempered cast iron article. Only actual testing can reliably measure machinability.

The milling test was performed on regular ductile iron articles (RDI) of the prior art having a BHN of 277 BHN, regular austempered ductile iron articles (ADI) of the prior art having a BHN of 311 BHN, and the machinable austempered cast iron articles (MADI) of the subject invention having a BHN of 302 BHN. A Kennametal KSSR 3.94-SE4-45-5 right hand cutter with a diameter of 100 mm was used. Kennametal KC520M inserts with a 25 micron hone edge preparation were used in the right hand cutter. The right hand cutter had a 45° lead angle, a radial rake of −5°, and an axial rake of 20°. A depth of cut was held constant at 2.3 mm. Cutting using a single Kennametal KC520M insert was performed to increase the wear rate and exclude the effects of non-uniform cutting. The results of the milling tests are shown in Table 7.

TABLE 7

| Feed | | X Forces (N) | | | Y Forces (N) | | | Z Forces (N) | | |
|---|---|---|---|---|---|---|---|---|---|---|
| Rate (mmpt) | Speed (smm) | RDI (p.a.) | ADI (p.a.) | MADI | RDI (p.a.) | ADI (p.a.) | MADI | RDI (p.a.) | ADI (p.a.) | MADI |
| 0.15 | 175 | 117 | 93 | 88 | 208 | 189 | 193 | 122 | 77 | 158 |
| 0.20 | 175 | 133 | 131 | 190 | 230 | 228 | 265 | 216 | 155 | 336 |
| 0.22 | 175 | | | 56 | | | 219 | | | 87 |
| 0.24 | 175 | | | 46 | | | 237 | | | 93 |
| 0.25 | 175 | 164 | 279 | 87 | 298 | 328 | 245 | 268 | 515 | 57 |
| 0.15 | 229 | 146 | 190 | 230 | 199 | 198 | 212 | 286 | 283 | 502 |
| 0.20 | 229 | 140 | 173 | 216 | 228 | 216 | 250 | 265 | 229 | 429 |
| 1 | 229 | | | 96 | | | 219 | | | 86 |
| 0.24 | 229 | | | 89 | | | 243 | | | 92 |
| 0.25 | 229 | 159 | 305 | 95 | 319 | 352 | 218 | 291 | 923 | 59 |

The milling tests show unique and unexpected machinability for the MADI of the subject invention. Machining forces were found to first increase and then decrease as feed rate increased. The machining forces have been verified through multiple tests. The decrease in machining forces may be due to work hardening behavior of the MADI. Nevertheless, the machinability of the MADI can be exploited to increase production rate and decrease wear on milling tools used on the MADI.

The drilling test was performed on RDI of the prior art having a BHN of 277 BHN, ADI of the prior art having a BHN of 311 BHN, and MADI of the subject invention having a BHN of 302 BHN. Kennametal grade KC 7210 drills with a TiAlN coating, a point angle of 130°, a helix angle of 30°, a rake angle of 60°, and a web thickness of 1.97 mm were used. A Kistler 9272A machining dynamometer was used to measure torque and thrust at various feed rates and drill speeds. Piezoelectric signals from the machining dynamometer were amplified and Labview software was used to gather the data. A 2000 Hz sampling rate was used. Results of the tests are shown in Table 8.

TABLE 8

| | | Thrust (N) | | | Torque (N) | | |
|---|---|---|---|---|---|---|---|
| Feed Rate (mmpt) | Drill Speed (smm) | RDI (p.a.) | ADI (p.a.) | MADI | RDI (p.a.) | ADI (p.a.) | MADI |
| 0.10 | 30 | 852 | 1213 | 828 | 205 | 378 | 278 |
| 0.20 | 30 | 1577 | 2302 | 1616 | 405 | 1062 | 429 |
| 0.10 | 76 | 913 | 1531 | 969 | 229 | 288 | 280 |
| 0.20 | 76 | 1750 | 2542 | 1729 | 451 | 529 | 546 |
| 0.10 | 122 | 1072 | 1421 | 1091 | 225 | 251 | 231 |
| 0.20 | 122 | 1794 | 2222 | 1635 | 415 | 456 | 424 |

TABLE 8-continued

| Feed Rate (mmpt) | Drill Speed (smm) | Thrust (N) RDI (p.a.) | Thrust (N) ADI (p.a.) | Thrust (N) MADI | Torque (N) RDI (p.a.) | Torque (N) ADI (p.a.) | Torque (N) MADI |
|---|---|---|---|---|---|---|---|
| 0.10 | 175 | 1213 | 1196 | 1081 | 198 | 261 | 239 |
| 0.20 | 175 | 1765 | 1997 | 1596 | 376 | 463 | 407 |

The drilling tests show thrust values for the MADI of the subject invention increased or increased then leveled off as drill speed increased and feed rate remained constant. Torque values increased and then decreased as drill speed increased and feed rate remained constant. The MADI performed best at higher speeds, indicating suitability for applications requiring drilling. The milling and drilling test results for the MADI show an improvement in machinability of the MADI over the RDI and ADI of the prior art.

Environmental cracking tests were performed to test resistance of the machinable austempered cast iron articles to cracking when exposed to environmental conditions. The machinable austempered cast iron articles are often subjected to harsh environmental conditions. For example, torsion bar adjusters and lower control arms, and engine parts are frequently subjected to moisture, oil from leaks, and fuel from spillage. When subjected to various strain rates, there may be a heightened rate of cracking as opposed to when the machinable austempered cast iron articles are dry. Thus, the machinable austempered cast iron articles must be sufficiently resistant to environmental cracking under such conditions to be economically and mechanically feasible for use in automotive applications.

The tests for resistance to environmental cracking were performed on samples of machinable austempered cast iron articles (MADI) of the subject invention having a BHN of 243 BHN, regular ductile iron (RDI) of the prior art, and regular austempered ductile iron (ADI) of the prior art. The samples were subjected to various types of fluid, including water, fresh motor oil, used motor oil, and diesel fuel. The samples were then subjected to various strain rates. Measurements of % El, UTS, and YS were made on the samples treated under the various conditions to determine how well the samples retained their properties. Results of the tests are shown in Table 9.

TABLE 9

| Fluid | Strain (in/in/min) | % El RDI (p.a.) | % El ADI (p.a.) | % El MADI | UTS (psi) RDI (p.a.) | UTS (psi) ADI (p.a.) | UTS (psi) MADI | YS (psi) RDI (p.a.) | YS (psi) ADI (p.a.) | YS (psi) MADI |
|---|---|---|---|---|---|---|---|---|---|---|
| Dry | 0 | 12.2 | 14.8 | 19.7 | 81,364 | 149,563 | 115,111 | 50,835 | 106,812 | 77,358 |
| $H_20$ | 1.0 | 13.4 | 8.4 | 18.1 | 78,078 | 143,090 | 115,125 | 50,476 | 106,861 | 78,803 |
| $H_20$ | 0.1 | 12.6 | 5.5 | 15.2 | 77,884 | 135,577 | 115,067 | 47,976 | 105,151 | 77,858 |
| $H_20$ | 0.01 | 13.5 | 4.6 | 14.8 | 75,943 | 132,633 | 112,500 | 45,514 | 104,495 | 73,915 |
| New Oil | 0.01 | | 9.0 | 15.9 | | 141,006 | 113,427 | | 103,933 | 76,779 |
| Used Oil | 0.01 | | 11.5 | 17.2 | | 147,097 | 113,403 | | 106,247 | 76,239 |
| Diesel Fuel | 0.01 | | 10.8 | 19.5 | | 145,538 | 113,910 | | 106,745 | 73,646 |

The results of the tests for resistance to environmental cracking show that the machinable austempered cast iron performed better than regular austempered ductile iron in terms of retaining % El and UTS. The machinable austempered cast iron performed better than regular ductile iron in terms of retaining UTS and YS. Furthermore, the machinable austempered cast iron did not show significant loss of % El, UTS, or YS under any of the tests. Thus, the machinable austempered cast iron exhibits improved resistance to environmental cracking over both regular ductile iron and regular austempered ductile iron.

Obviously, many modifications and variations of the present invention are possible in light of the above teachings. The invention may be practiced otherwise than as specifically described within the scope of the appended claims.

What is claimed is:

1. A method of making a machinable austempered cast iron article from an iron composition having a substantially pearlitic microstructure that includes carbon, silicon, nickel, copper, and molybdenum, said method comprising the steps of:

austenitizing the substantially pearlitic microstructure in an intercritical temperature range of from 1380° F. to 1500° F. for a period of at least 10 minutes to produce a ferritic plus austenitic microstructure;

quenching the ferritic plus austenitic microstructure at a rate sufficient to prevent formation of pearlite;

austempering the ferritic plus austenitic microstructure in an austempering temperature range of from 575° F. to 750° F. for a period of at least 8 minutes to produce a microstructure of a continuous matrix of equiaxed ferrite with islands of austenite; and cooling the microstructure of the continuous matrix of equiaxed ferrite with islands of austenite to ambient temperature to produce the machinable austempered cast iron article having improved strength, ductility, machinability, fatigue performance, and resistance to environmental cracking.

2. A method according to claim 1 further comprising the step of casting the iron composition to produce the substantially pearlitic microstructure having at least 80% pearlite prior to austenitizing.

3. A method according to claim 1 wherein the step of austenitizing the substantially pearlitic microstructure is further defined as austenitizing the substantially pearlitic microstructure in an intercritical temperature range of from 1380° F. to 1472° F.

4. A method according to claim 1 wherein the step of austenitizing the substantially pearlitic microstructure is further defined as austenitizing the substantially pearlitic microstructure in an intercritical temperature range of from 1380° F. to 1449° F.

5. A method according to claim 1 wherein the step of austenitizing the substantially pearlitic microstructure is further defined as austenitizing the substantially pearlitic microstructure for a period of from 10 to 360 minutes.

6. A method according to claim 1 wherein the step of austempering the ferritic plus austenitic microstructure is further defined as austempering the ferritic plus austenitic microstructure for a period of from 8 to 1440 minutes.

7. A method according to claim 6 wherein the step of austempering the ferritic plus austenitic microstructure is further defined as austempering the ferritic plus austenitic microstructure for a period of from 60 minutes to 180 minutes.

8. A method according to claim 1 wherein the step of quenching the ferritic plus austenitic microstructure is further defined as quenching the ferritic plus austenitic microstructure into the austempering temperature range of from 575° F. to 750° F. within a period of from 5 to 180 seconds to prevent the formation of pearlite.

9. A method according to claim 1 wherein the step of quenching the ferritic plus austenitic microstructure is further defined as quenching the ferritic plus austenitic microstructure into the austempering temperature range in a salt bath.

10. A method according to claim 9 wherein the salt bath comprises at least one of nitrate salts, nitrite salts, and combinations thereof.

11. A method according to claim 1 wherein the step of quenching the ferritic plus austenitic microstructure is further defined as quenching the ferritic plus austenitic microstructure into the austempering temperature range in a fluidized bed.

12. A method according to claim 1 wherein the step of cooling the microstructure of the continuous matrix of equiaxed ferrite with islands of austenite to ambient temperature is further defined as cooling the microstructure of the continuous matrix of equiaxed ferrite with islands of austenite to ambient temperature in at least one of air, oil, and water.

13. A method according to claim 1 wherein the machinable austempered cast iron article is a crankshaft component.

14. A method according to claim 1 wherein the machinable austempered cast iron article is a chassis component.

15. A method of making a machinable austempered cast iron article from an iron composition that includes carbon, silicon, nickel, copper, and molybdenum, said method comprising the steps of:

casting the iron composition at a temperature of greater than 2200° F.;

cooling the iron composition to a temperature of from 1000° F. to 1340° F.;

holding the iron composition at the temperature of from 1000° F. to 1340° F. for at least 8 seconds to produce a substantially pearlitic microstructure;

cooling the iron composition to an ambient temperature;

austenitizing the substantially pearlitic microstructure in an intercritical temperature range of from 1380° F. to 1500° F. for a period of at least 10 minutes to produce a ferritic plus austenitic microstructure;

quenching the ferritic plus austenitic microstructure at a rate sufficient to prevent formation of pearlite;

austempering the ferritic plus austenitic microstructure in an austempering temperature range of from 575° F. to 750° F. for a period of at least 8 minutes to produce a microstructure of a continuous matrix of equiaxed ferrite with islands of austenite; and cooling the microstructure of the continuous matrix of equiaxed ferrite with islands of austenite to ambient temperature to produce the machinable austempered cast iron article having improved strength, machinability, fatigue performance, and resistance to environmental cracking.

16. A method according to claim 15 wherein the step of austenitizing the substantially pearlitic microstructure is further defined as austenitizing the substantially pearlitic microstructure having at least 80% pearlite in an intercritical temperature range of from 1380° F. to 1472° F.

17. A method according to claim 15 wherein the step of austenitizing the substantially pearlitic microstructure is further defined as austenitizing the substantially pearlitic microstructure having at least 80% pearlite in an intercritical temperature range of from 1380° F. to 1449° F.

18. A method according to claim 15 wherein the step of austenitizing the substantially pearlitic microstructure is further defined as austenitizing the substantially pearlitic microstructure for a period of from 10 to 360 minutes.

19. A method according to claim 15 wherein the step of austempering the ferritic plus austenitic microstructure is further defined as austempering the ferritic plus austenitic microstructure for a period of from 8 to 1440 minutes.

20. A method according to claim 19 wherein the step of austempering the ferritic plus austenitic microstructure is further defined as austempering the ferritic plus austenitic microstructure for a period of from 60 minutes to 180 minutes.

21. A method according to claim 15 wherein the step of quenching the ferritic plus austenitic microstructure is further defined as quenching the ferritic plus austenitic microstructure into the austempering temperature range of from 575° F. to 750° F. within a period of from 5 to 180 seconds to prevent the formation of pearlite.

22. A method according to claim 15 wherein the step of quenching the ferritic plus austenitic microstructure is further defined as quenching the ferritic plus austenitic microstructure into the austempering temperature range in a salt bath.

23. A method according to claim 22 wherein the salt bath comprises at least one of nitrate salts, nitrite salts, and combinations thereof.

24. A method according to claim 15 wherein the step of quenching the ferritic plus austenitic microstructure is further defined as quenching the ferritic plus austenitic microstructure into the austempering temperature range in a fluidized bed.

25. A method according to claim 15 wherein the step of cooling the microstructure of the continuous matrix of equiaxed ferrite with islands of austenite to ambient temperature is further defined as cooling the microstructure of the continuous matrix of equiaxed ferrite with islands of austenite to ambient temperature in at least one of air, oil, and water.

26. A method according to claim 15 wherein the machinable austempered cast iron article is a crankshaft component.

27. A method according to claim 15 wherein the machinable austempered cast iron article is a chassis component.

* * * * *